US005078159A

United States Patent [19]

Yuhara

[11] Patent Number: 5,078,159

[45] Date of Patent: Jan. 7, 1992

[54] COMPACT CASE

[75] Inventor: Tokiyo Yuhara, Tokyo, Japan

[73] Assignee: Yoshida Industry Co., Ltd., Tokyo, Japan

[21] Appl. No.: 583,641

[22] Filed: Sep. 17, 1990

[30] Foreign Application Priority Data

Sep. 18, 1989 [JP] Japan ..... 1-108337[U]

[51] Int. Cl.[5] ..... A45D 33/22

[52] U.S. Cl. ..... 132/295; 132/293; 132/301; 132/315; 206/45.23; 206/581; 206/823; 220/333

[58] Field of Search ..... 132/293, 294, 295, 296, 132/298, 300, 301, 315, 316; 206/45.2, 45.23, 581, 823, 235; 220/343, 342, 333

[56] References Cited

U.S. PATENT DOCUMENTS

| | | | |
|---|---|---|---|
| 2,642,202 | 6/1953 | Cowan | 132/301 |
| 4,195,650 | 4/1980 | Ullmann et al. | 132/294 |
| 4,399,826 | 8/1983 | Ogasawara | 132/301 |
| 4,684,017 | 8/1987 | Watanabe et al. | 220/343 |
| 4,693,392 | 9/1987 | Contreras, Sr. | 220/343 |
| 4,964,526 | 10/1990 | Stephens | 132/315 |

FOREIGN PATENT DOCUMENTS

| | | | |
|---|---|---|---|
| 3209987 | 3/1983 | Fed. Rep. of Germany | 132/293 |

*Primary Examiner*—John J. Wilson
*Assistant Examiner*—Frank A. LaViola
*Attorney, Agent, or Firm*—Wenderoth, Lind & Ponack

[57] ABSTRACT

A compact case includes a receptacle member and a cover member connected to each other through a hinge in such a manner that the cover member is opened or closed relative to the receptacle member. The compact case includes a first concave notch provided at the rear end portion of the receptacle member, a hinge portion provided at the rear end portion of the cover member, a second concave notch provided at the upper portion of the hinge for accommodating the hinge portion, a first support for supporting the cover member with respect to the hinge so that the cover member is rotated about the first support, and a second support for supporting the hinge with respect to the receptacle member so that the hinge is rotated about the second support.

8 Claims, 5 Drawing Sheets

COMPACT CASE

BACKGROUND OF THE INVENTION

The present invention relates to a compact case for cosmetics and comprising a receptacle member and a cover member which are connected to each other through a hinge, and more particularly to a compact case in which the cover member may be opened more than 180° relative to the receptacle member, and which can be suitably displayed for sale in such a manner that the interior cosmetics can be seen from the outside.

In general, a compact case basically comprises a receptacle member for accommodating cosmetics therein and a cover member, and the receptacle member and the cover member are rotatably connected to each other at respective ends through a hinge so that the cover member can be opened or closed relative to the receptacle member.

Conventionally, this type of compact case is disclosed in Japanese Utility Model Publication No. 63-40164.

In such disclosed compact case, the receptacle member and the cover member are formed with, at respective rear ends, concave notches which are communicated with each other. The hinge is provided in the concave notches so that the rear end face thereof does not project outwardly from the rear end faces of the receptacle member and the cover member. The hinge has an upper portion which is rotatably connected to the cover member through a first shaft horizontally provided in the concave notch of the cover member, and a lower portion which is rotatably connected to the receptacle member through a second shaft horizontally provided in the concave notch of the receptacle member.

According to this compact case, when displaying the compact case for sale in such a manner that the interior cosmetics can be seen from the outside, the cover member is opened more than 180° about the second shaft so that the upper face of the cover member abuts the bottom face of the receptacle member. On the other hand, when the compact case is normally used, the cover member can be opened less than 180° about the first shaft so that makeup may be applied while looking at a mirror provided on the interior surface of the cover member.

However, in the conventional compact case, the concave notches are formed not only on the receptacle member, but also on the cover member. Therefore, when the concave notch is formed so that the notch pierces through the cover member in a vertical direction, the hinge provided at the rear end of the compact case is exposed on the upper face of the cover member, thus spoiling the appearance of the compact case. Further, since a design must be applied on the upper face of the cover member while taking the notch into consideration, the design is subject to limitations.

In the case where the first and second shafts are provided on the receptacle member and the cover member, respectively, not by being integrally forming therewith, but by being separately forming therefrom, the first and second shafts are inserted into the receptacle member and the cover member from both sides thereof. Therefore, four holes in total must be formed at the rear end portion on both sides of the receptacle member and the cover member, which also spoils the appearance of the compact case.

On the other hand, when the concave notch is formed on the cover member while maintaining an upper wall without piercing entirely through the cover member, the wall of the cover member by which the hinge is covered interferes with the hinge, so that the cover member cannot be opened in such a manner that the upper face of the cover member abuts against the bottom face of the receptacle member. Accordingly, in order to display cosmetics or the like accommodated in the compact case in a visible state from the outside, the cover member must be opened by 180° at a maximum, and thus the cover member extends from the receptacle member to thereby make the overall compact case bulky.

SUMMARY OF THE INVENTION

It is therefore an object of the present invention to provide a compact case in which a hinge is not exposed on the upper face of the cover member and a plurality of holes for supporting shafts are not formed on the receptacle member and the cover member, such that the aesthetic appearance of the case can be improved.

Another object of the present invention is to provide a compact case in which the cover member may be opened more than 180° relative to the receptacle member, and which can be suitably displayed for sale in such a manner that the interior cosmetics can be seen from the outside without being bulky.

In order to achieve the above objects, according to the present invention there is provided a compact case including a receptacle member and a cover member connected to each other through a hinge in such a manner that the cover member is opened or closed relative to the receptacle member, the compact case comprising: a first concave notch provided at the rear end portion of the receptacle member, the hinge being accommodated in the first concave notch so that the hinge is not projected outward rearwardly beyond the rear end face of the receptacle member; a hinge portion provided at the rear end portion of the cover member and extending downwardly from the cover member; a second concave notch provided at the upper portion of the hinge, the hinge portion being fitted within the second concave notch; first supporting means for supporting the cover member with respect to the hinge so that the cover member may be rotated about the first supporting means; and second supporting means for supporting the hinge with respect to the receptacle member so that the hinge may be rotated about the second supporting means.

With the above structure, the cover member is opened by approximately 90° at its maximum relative to the receptacle member through the first supporting means, and the cover member is further opened by approximately 360° relative to the receptacle member through the second supporting means so that the upper face of the cover member abuts against the bottom face of the receptacle member. The concave notch for accommodating the hinge is provided on the receptacle member so that the hinge does not project from the rear end face of the receptacle member, and a concave notch is not provided in the cover member. As a result, the hinge is not exposed on the upper face of the cover member. The hole for inserting the first supporting means is exposed on both side faces of the hinge, but the hole cannot seen from the outside because the hinge is accommodated in the concave notch at the rear end portion of the receptacle member.

The above and other objects, features and advantages of the present invention will become more apparent from the following description when taken in conjunction with the accompanying drawings in which preferred embodiments of the present invention are shown by way of illustrative examples.

DETAILED DESCRIPTION OF THE INVENTION

A compact case according to a first embodiment of the present invention will be described below with reference to FIGS. 1 through 4.

Figure 1:
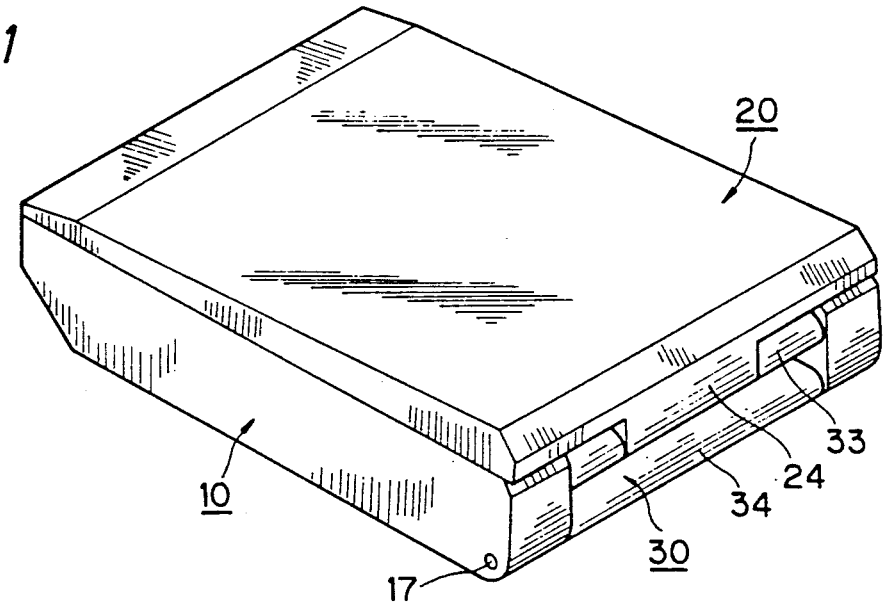
FIG. 1 is a perspective view showing a compact case in which a cover member is closed, according to a first embodiment of the present invention.
Figure 2:
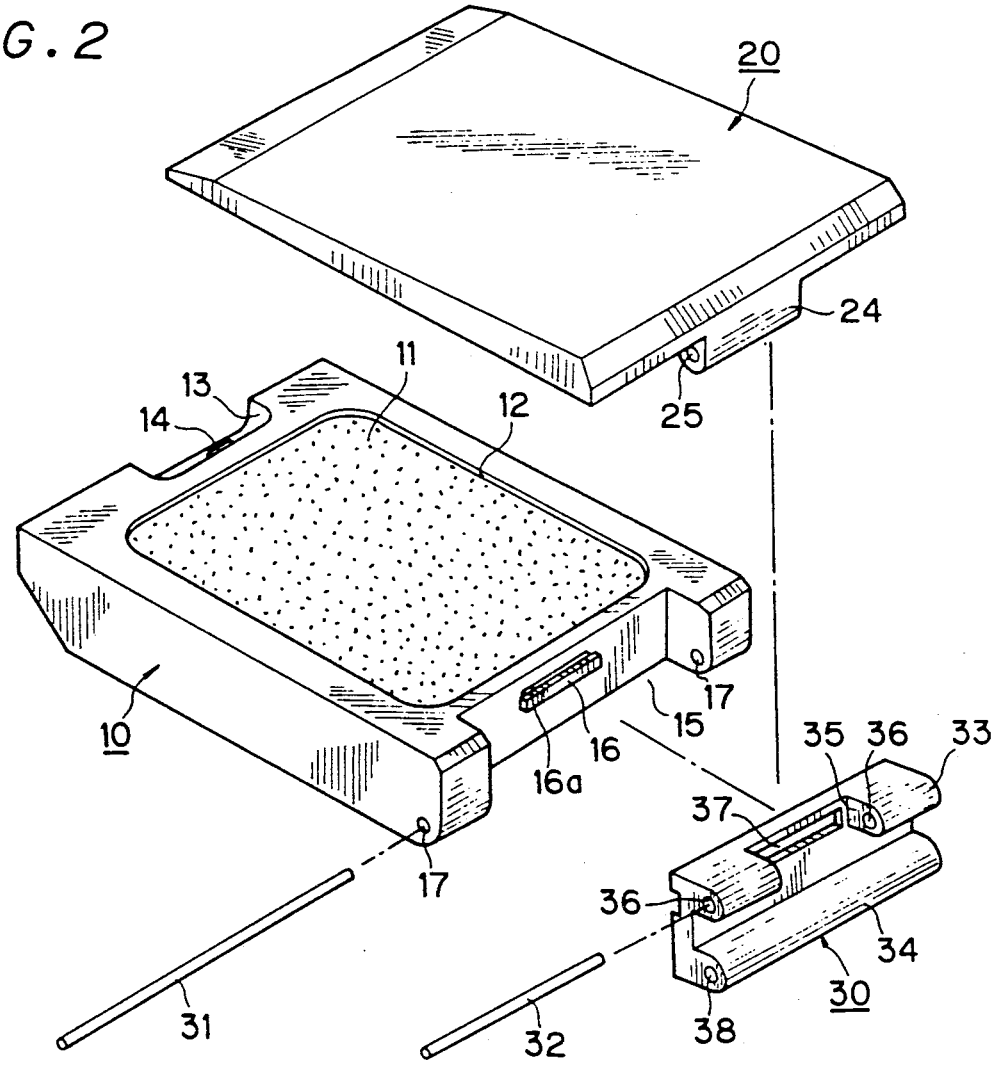
FIG. 2 is an exploded perspective view showing a receptacle member, a cover member and a hinge.
Figure 3A:
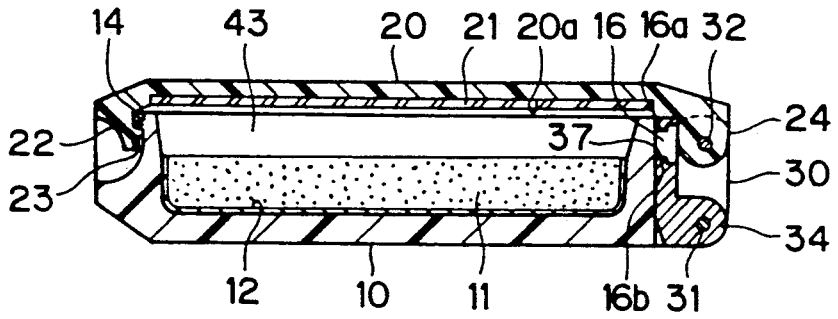
FIGS. 3(*a*) through 3(*d*) are explanatory cross-sectional views showing a compact case in the state where a cover member is being opened from the closed position.
Figure 3B:
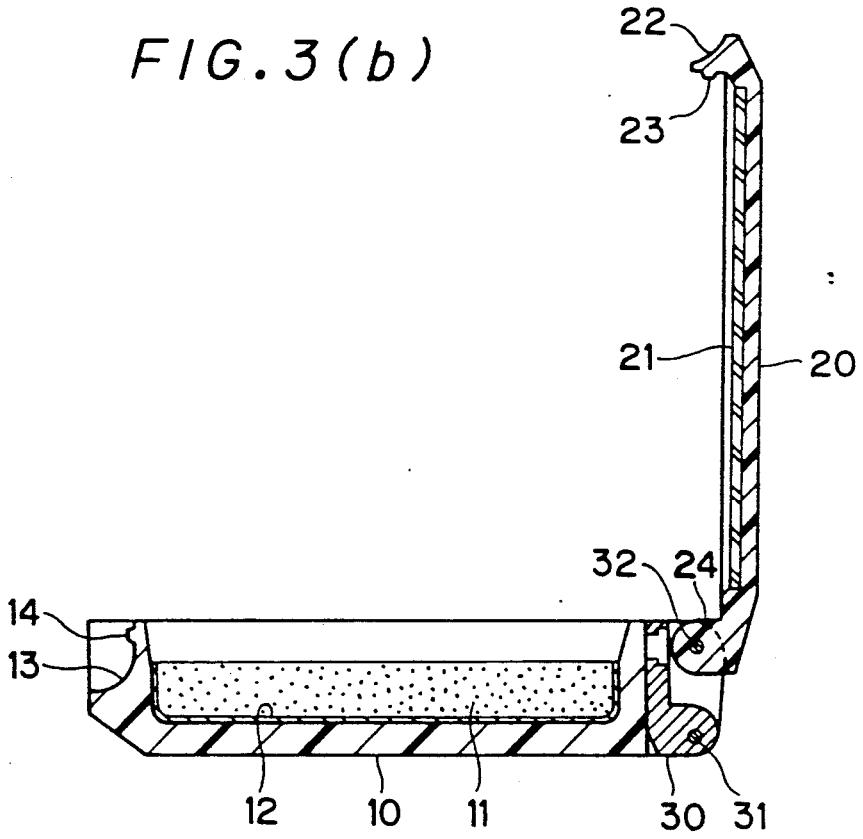
Figure 3C:
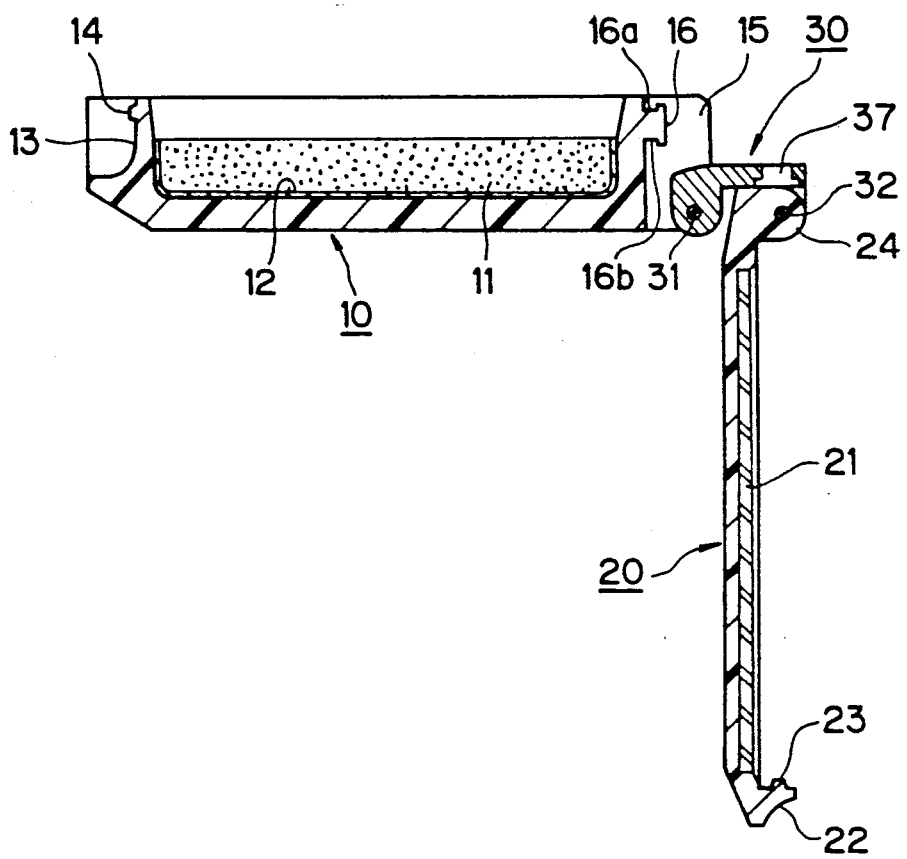
Figure 3D:
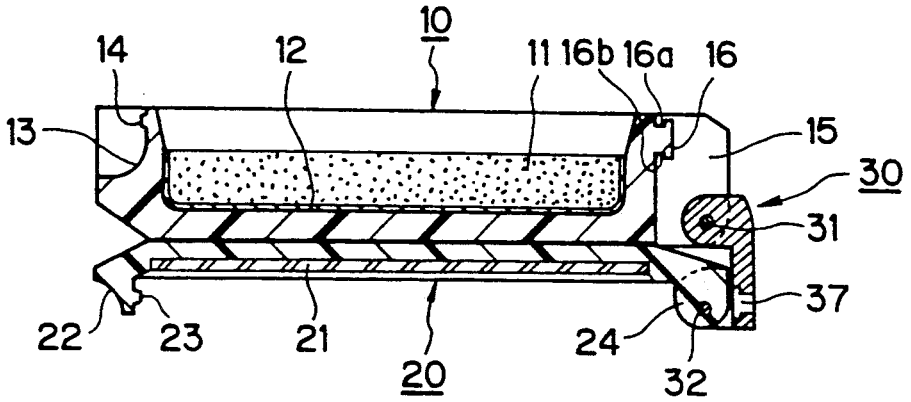

A compact case includes a receptacle member 10 in the form of a thin rectangular parallelepiped, and a cover member 20 hinged with the receptacle member 10 through a hinge 30 as shown in FIGS. 1 and 2. The receptacle member 10 is provided with a large rectangular recess 12 at an upper surface thereof. A cosmetic 11 such as cosmetic powder is filled in the recess 12. A U-shaped cut on recess 13 is formed at the central portion of the front end face of the receptacle member 10. The U-shaped cut 13 has an approximately sector-shaped cross-section for inserting or receiving a finger tip or a nail. A first engaging projection 14 is formed at an upper portion of the interior wall of the U-shaped cut 13 integrally with the receptacle member 10 as shown in FIGS. 2 and 3(*a*). A concave notch 15 constituting a first concave notch and extending through the receptacle member 10 vertically is formed at the central portion of the rear end portion of the receptacle member 10. An engaging projection 16 constituting a first engaging member is formed at the central portion of the interior wall of the notch 15 integrally with the receptacle member 10. The engaging projection 16 is slightly cut at upper and lower sides of the base portion thereof so as to form substantially V-shaped grooves 16*a*, 16*b*. The engaging projection 16 is engageable with an engaging member of the hinge 30 by snap engagement (described hereinafter). On both side walls of the notch 15, there are provided holes 17, which extend in a horizontal direction, for inserting a second shaft 31 constituting second supporting means.

On the other hand, the cover member 20 is formed to have almost the same thin rectangular parallelepiped shape as does the receptacle member 10. The cover member 20 is also provided with a rectangular recess 20*a*, and a mirror 21 is integrally attached to the inner surface of the cover member 20 so as to be embedded in the recess 20*a*.

A claw piece 22 is formed at the central portion of the front end of the receptacle member 20 so that the claw piece 22 extends downwardly therefrom, and a second engaging projection 23 is integrally formed on the inner surface of the claw piece 22 as shown in FIG. 3(*a*). The second engaging projection 23 is engageable with the first engaging projection 14. The cover member 20 is integrally formed with a hinge portion 24, which extends downward therefrom, at the central portion of the rear end of a lower surface thereof. A through hole 25 is formed in the hinge portion 24 so that the hole 25 extends through the hinge portion 24 in a horizontal direction. A first shaft 32 constituting first supporting means is inserted into the through hole 25 to rotatably connect the hinge portion 24 with the hinge 30.

The hinge 30 has a shape corresponding to the notch 15 and is completely fitted within the notch 15. To be more specific, the thickness in the front-rear direction of the hinge 30 is substantially equal to the depth of the notch 15 so that hinge 30 does not project from the rear end of the receptacle member 10, and the height of the hinge 30 is substantially equal to the height of the notch 15 so that hinge 30 does not upwardly project from the notch 15.

At an upper portion of the hinge 30, there is provided an upper projection 33 which has a semicircular cross-section and extends in a horizontal direction. Further, at a lower portion of the hinge 30, there is provided a lower projection 34 which also has a semicircular cross-section and extends in a horizontal direction, as shown in FIG. 2. A concave notch 35 constituting a second concave notch and extending through the upper projection 33 vertically is formed in the central portion of the upper projection 33 so as to rotatably receive the hinge portion 24. The upper projection 33 has a through hole 36 which extends in a horizontal direction so as to align the through hole 25 coaxially. An engaging opening 37 constituting a second engaging member is formed at the interior wall of the notch 35 so as to be engageable with the engaging projection 16. The depth in the front-rear direction of the notch 35 is determined so that the hinge portion 24 does not project from the upper projection 33.

On the other hand, the lower projection 34 also has a through hole 38 which extends in a horizontal direction so as to align coaxially with the through hole 17 formed on the receptacle member 10.

When assembling the compact case, first the hinge portion 24 formed at the rear end of the cover member 20 is fitted within the concave notch 35, and the first shaft 32 is inserted into the through holes 36 and 25 in the state where the through hole 25 aligns with the through hole 36. Thereafter, the hinge 30 to which the cover member 20 is connected is fitted within the notch 15 provided at the rear end of the receptacle member 10, simultaneously the engaging projection 16 is engaged with the engaging opening 37, and then the first shaft 31 is inserted into the through holes 17 and 38.

With the above manner of assembly, the cover member 20 is rotatably connected to the receptacle member 10 through the hinge 30. When closing the cover member 20 relative to the receptacle member 10, the claw piece 22 is introduced into the U-shaped cut 13 formed at the front end of the receptacle member 10. At this time, the second engaging projection 23 is engaged with the first engaging projection 14, and the cover member 20 is maintained in a closed position relative to the receptacle member 10 by snap engagement. At this closed position, a storage space 43 for accommodating a puff or the like is defined between the interior surface of the cover member 20 and the upper face of the receptacle member 10 as shown in FIG. 3(*a*).

In the compact case according to the first embodiment, at this closed position of the cover member 20, the hinge 30 is not exposed at the upper face of the cover member 20 at the rear end portion of the compact case. Therefore, the aesthetic effect is not spoiled by the presence of the hinge 30 and a design can be freely applied on the entire upper face of the cover member 20 without any restriction. Further, the hinge 30 and the hinge portion 24 do not project from the rear end of the receptacle member 10, therefore, the appearance of the compact case is not spoiled by their presence.

Further, in the compact case according to the first embodiment of the present invention, when opening the cover member 20 from the closed position thereof, the claw piece 22 is touched with a finger tip or a nail and the cover member 20 is pushed upward, thereby disengaging the second engaging projection 23 from the first engaging projection 14. At this time, the cover member 20 is rotated about the first shaft 32, so that the cover member 20 can be opened by approximately 90° as shown in FIG. 3(*b*). In this position, the inner surface at the rear end portion of the cover member 20 abuts against the vertical rear end face of receptacle member 10, whereby further rotation of the cover member 20 about the first shaft 32 is prevented. If desired, the compact case can be used in this state of halfway opening.

Thereafter, when the cover member 20 is further rotated by employing a slightly strong force in the opening direction thereof, the engaging opening 37 is disengaged from the engaging projection 16 by the rotational force acting upon the hinge 30, and the cover member 20 is rotated about the second shaft 31 together with the hinge 30. Such rotational movement causes the rear end portion of cover member 20 to move away from the rear end face of receptacle member 10, thus allowing the cover member 20 to rotate about the first shaft 32 by 180° where the hinge portion 24 abuts against the outer surface of hinge 30 as shown in FIG. 3(*c*). Finally, the cover member 20 is brought into a position rotated by 360° so that the upper face of the cover member 20 abuts against the bottom face of the receptacle member 10 as shown in FIG. 3(*d*).

Figure 4:
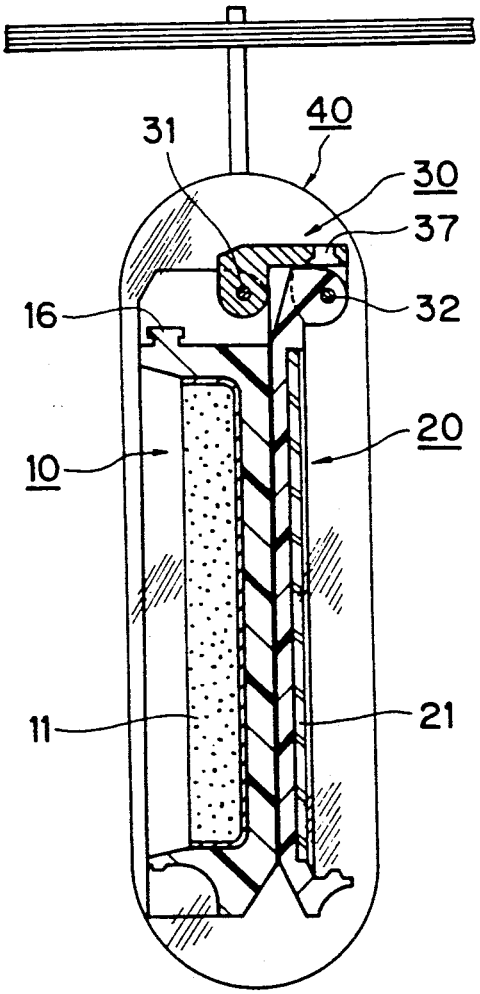
FIG. 4 is a explanatory cross-sectional view showing a compact case in the state packaged with a transparent or semitransparent film.

Accordingly, if the compact case is packaged in this state, for example, with a transparent or semitransparent plastic film 40 as shown in FIG. 4, interior cosmetic 11 can be seen from the outside and the size of the compact case as packaged can be made small without being bulky. Therefore, the compact case is suitably displayed for sale in this state as shown in FIG. 4.

Further, the through hole 25 for rotatably connecting the cover member 20 with the hinge 30 remains hidden within the notch 35, and the other through hole 36 also remains hidden within the notch 15. Consequently, the only hole that is exposed on the outer face of the compact case is the hole 17 that is visible at the rear portion of both sides of the receptacle member 10 (see FIG. 1), and thus the appearance of the compact case is not spoiled by the presence of a large number of holes.

Furthermore, the V-shaped grooves 16*a*, 16*b* formed on the engaging projection 16 are engaged with the peripheral edge defining the engaging opening 37, thereby maintaining the engagement of the engaging projection 16 and the engaging opening 37. As a result, the hinge 30 is held in a stationary condition in the notch 15. Therefore, in the normal state of use where the cover member 20 is opened within approximately 90° (see FIG. 3(*b*)), the cover member 20 is rotated about the first shaft 32, thereby preventing the cover member 20 from being rotated about the second shaft 31.

Next, a modified embodiment of the present invention will be described below.

In the first embodiment, the second and first shafts 31, 32 for rotatably connecting the cover member 20 with the receptacle member 10 are inserted into the holes 17, 38 and 25, 36 of the receptacle member 10, the hinge 30 and the cover member 20. However, many modifications may be made. For example, the second shaft 31 may be provided horizontally in the notch 15 and the first shaft 32 also may be provided horizontally in the notch 35 by inserting a mold, or the second shaft 31 and the first shaft 32 may be formed integrally with the receptacle member 10 and the hinge 30, respectively. In such case, lateral slits having a diameter slightly smaller than that of the through holes 38 and 25 are formed to communicate with the through holes 38 and 25, respectively, and the lateral slits extend in a longitudinal direction of the hinge portion 24 and the hinge 30, respectively, and are open at one side thereof. The hinge portion 24 and the hinge 30 are preferably made of plastic to allow the wall portions defining the lateral slits to have a certain elasticity.

Further, in the first embodiment, the V-shaped grooves 16*a*, 16*b* are provided at the base portion of the engaging projection 16 to enable the engaging projection 16 to engage with the engaging opening 37. However, these V-shaped grooves 16*a*, 16*b* may be eliminated. In such case, the engaging projection 16 or the engaging opening 37 is formed so that the engaging projection 16 is tightly fitted with the engaging opening 37.

Furthermore, an engaging recess may be formed as an engaging member instead of the engaging projection 16 provided at the notch 15, and an engaging projection may be formed as an engaging member instead of the engaging opening 37.

Next, a second embodiment of the present invention will be described below with reference to FIG. 5.

Figure 5:
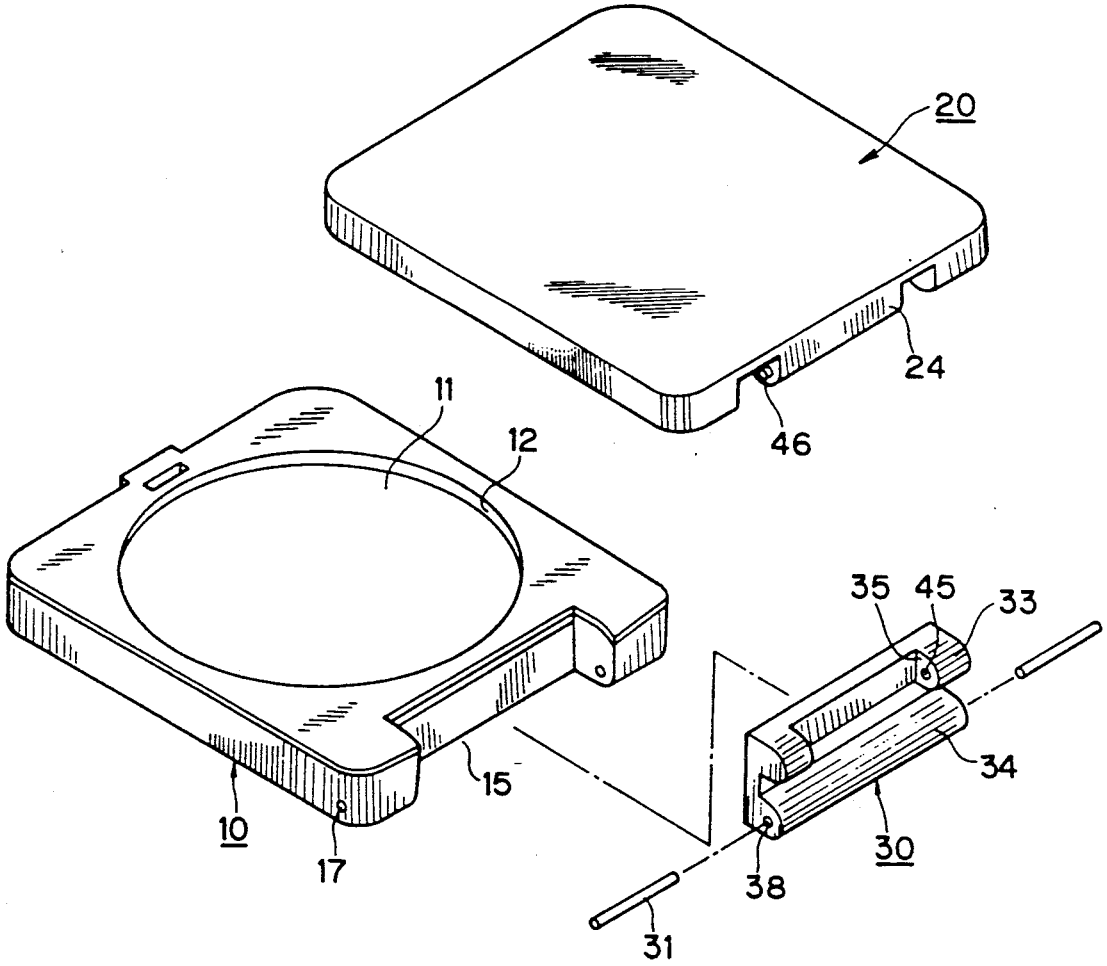
FIG. 5 is an exploded perspective view showing a compact case according to a second embodiment of the present invention.

Those parts shown in FIG. 5 which are structurally and functionally identical to those shown in FIGS. 1 through 4 are denoted by identical reference numerals, and will not be described in detail.

The structure of the second embodiment in FIG. 5 will be described in comparison with that of the first embodiment in FIG. 2.

In the second embodiment, the receptacle member 10 is not provided with the engaging projection 16 (see FIG. 2) in the notch 15, as shown in FIG. 5. Further, the hinge 30 is not provided with the engaging opening 37 and the through holes 36 (see FIG. 2). The hinge 30 is provided with a pair of concave recesses 45 (only one side is shown) on both side walls of the notch 35 as shown in FIG. 5.

On the other hand, the cover member 20 is not provided with the through hole 25 (see FIG. 2) at the hinge portion 24 as shown in FIG. 5. A pair of convex projections 46 (only one side is shown) is formed on both side walls of the hinge portion 24 as shown in FIG. 5. In this embodiment, the pair of convex projections 46 and the pair of concave recesses 45 jointly constitute first supporting means.

When assembling the compact case, the hinge portion 24 is fitted within the concave notch 35. At this time, the pair of the convex projections 46 of the cover member 20 are engaged with the pair of the concave recesses 45 so that the cover member 20 is rotatably supported by the hinge 30. Thereafter the hinge 30 to which the cover member 20 is connected is fitted within the notch 15 of the receptacle member 10, and then the second shaft 31 is inserted into the through holes 17 and 38. In the second embodiment, it should be noted that a pair of concave recesses may be provided on the cover member 20 and a pair of convex projections may be provided on the hinge 30. Further, a pair of concave recesses and a pair of convex projections may be provided on the receptacle member and the hinge, respectively, instead of the second shaft 31.

Operation and effect of the compact case in the second embodiment is identical to those of the compact case in the first embodiment.

As is apparent from the foregoing description, according to the compact case of the present invention, the following effects are attainable.

(1) Since the concave notch for accommodating the hinge is provided on the receptacle member so that the hinge does not project from the rear end face of the receptacle member, and the concave notch is not provided on the cover member, the hinge is not exposed on the upper face of the cover member. Therefore, the appearance of the compact case is not spoiled by the presence of the hinge, and a design can be freely applied on the entire upper face of the cover member without any restriction.

(2) Since the compact case can be packaged in the state where the cover member is opened by approximately 360°, for example, with a transparent or semi-transparent plastic film, interior cosmetics can be seen from the outside and the size of the compact case as packaged can be made small without being bulky.

(3) Since the number of holes which are exposed on the outer face of the compact case are minimized, the appearance of the compact case is not spoiled by the presence of the holes.

(4) In the case where an engaging member is provided in the concave notch of the receptacle member and a member to be engageable with the engaging member is provided on the hinge, when opening the cover member relative to the receptacle member about the first shaft, the hinge is not rotated about the second shaft insignificantly. Therefore, the compact case of the present invention is very convenient for use.

Although certain preferred embodiments have been shown and described, it should be understood that many changes and modifications may be made therein without departing from the scope of the appended claims.

What is claimed is:

1. A compact case comprising:

a receptacle member including a rear end portion having formed therein a first concave notch defined by an end wall and a pair of spaced side walls, said rear end portion further having rear end faces on opposite sides of said first concave notch;

a hinge member accommodated in and fitted within said first concave notch, a hinge member having formed in an upper end portion thereof a second concave notch;

a cover member including a rear end portion having a continuous rear end face uninterrupted by a recess formed therein, said rear end portion of said cover member having integral therewith a hinge projection accommodated in and fitted within said second concave notch;

first supporting means for pivotably securing said hinge projection in said second concave notch to allow said cover member to rotate with respect to said hinge member;

second supporting member for pivotably securing said hinge member in said first concave notch to allow said hinge member to rotate with respect to said receptacle member;

whereby rotational movement of said cover member relative to said hinge member and rotational movement of said hinge member relative to said receptacle member enable said cover member to rotate from a closed position by about 360° relative to said receptacle member; and said rear end face of said cover member being flush with said rear end faces of said receptacle member in said closed position of said cover member.

2. The compact case as recited in claim 1, further comprising a first engaging member formed on said end wall of said first concave notch and a second engaging member formed on said hinge member, said first and second engaging members adapted to be engaged with each other for preventing rotational movement of said hinge member relative to said receptacle member during an initial stage of rotational movement of said cover member from said closed position relative to said hinge member.

3. The compact case as recited in claim 2, wherein said first engaging member comprises a projection extending rearwardly from said end wall of said first concave notch and said second engaging member comprises an opening formed through a wall of said hinge member.

4. The compact case as recited in claim 1, wherein said hinge member has a vertical wall, a lower projection extending rearwardly from said vertical wall and a pair of spaced upper projections parallel to said lower projection, and wherein said second concave notch is defined between said pair of upper projections.

5. The compact case as recited in claim 4, wherein said first supporting means comprises a first hole formed through each said upper projection, a second hole formed through said hinge projection and a first shaft inserted into said first and second holes.

6. The compact case as recited in claim 4, wherein said first supporting means comprises a pair of concave recesses provided on one of said hinge projection and said upper projections, and a pair of bosses provided on the other of said hinge projections and said upper projections and adapted to be engaged with said concave recesses.

7. The compact case as recited in claim 4, wherein said second supporting means comprises a third hole formed through said lower projection, a fourth hole formed through each said side wall of said receptacle member and a second shaft inserted into said third and fourth holes.

8. The compact case as recited in claim 4, wherein said second supporting means comprises a pair of concave recesses provided on one of said side walls of said receptacle member and said lower projection, and a pair of bosses provided on the other of said side walls and said lower projection and adapted to be engaged with said concave recesses.

* * * * *